United States Patent [19]

Mazier

[11] 4,179,910

[45] Dec. 25, 1979

[54] APPARATUS FOR MANUFACTURING DEFORMABLE EXPANSION BELLOWS FOR PIPE-WORK

[75] Inventor: Paul Mazier, Rillieux la Pape, France

[73] Assignee: S.F.Z. Souplesse Fonctionnelle Systematique, Chassieu, France

[21] Appl. No.: 872,494

[22] Filed: Jan. 26, 1978

[30] Foreign Application Priority Data

Apr. 2, 1977 [FR] France ..... 77 03696

[51] Int. Cl.[2] ..... B21D 15/06

[52] U.S. Cl. ..... 72/59; 72/62

[58] Field of Search ..... 72/57, 58, 59, 61, 62

[56] References Cited

U.S. PATENT DOCUMENTS

| | | | |
|---|---|---|---|
| 349,718 | 9/1886 | Hollerith et al. | 72/59 |
| 2,044,710 | 6/1936 | Mantle | 72/59 |
| 2,887,146 | 5/1959 | Heiteiman | 72/59 X |
| 3,091,280 | 5/1963 | Yowell et al. | 72/59 |
| 3,194,041 | 7/1965 | Johnson | 72/59 |
| 4,065,947 | 1/1978 | Mazier | 72/56 |

*Primary Examiner*—Leon Gilden

*Attorney, Agent, or Firm*—Fleit & Jacobson

[57] ABSTRACT

The manufacture of hydroforming of a deformable expansion bellows. A deformable sleeve is held on a support with an inner sleeve supported inside it to define a space into which is injected liquid under pressure. An axial force is applied to the sheath with the space pressurized to produce corrugation of the sheath so as to form a bellows.

10 Claims, 3 Drawing Figures

APPARATUS FOR MANUFACTURING DEFORMABLE EXPANSION BELLOWS FOR PIPE-WORK

The present invention concerns the formation, by the technique of hydroforming, of deformable expansion bellows mounted on pipe-word assemblies or similar industrial installations with a view to compensating for and withstanding deformations resulting from changes in temperature of the fluid which flows through the pipe-work assembly.

U.S. Ser. No. 747,103, filed 3rd Dec. 1976 U.S. Pat. No. 4,065,947 in the name of Paul Mazier had for an object a simplified apparatus for carrying out the process of manufacture by hydroforming. This apparatus comprised a vertical casing reinforced by a cement core and provided with a fixed upper ring which could be removed; and the casing was slidably mounted a movable ring fixed to a skirt sealingly surrounding the fixed ring so that the introduction of a fluid under controlled pressure into the space formed between the two rings caused the forced descent of the movable ring. It thus sufficed to engage around the lower part of the casing the usual sheath intended to form the bellows, this sheath being provided with end flanges and annular stays; the displacement of the movable ring determined the corrugation of the sheath between the aforesaid flanges and stays, in the usual manner in the technique of hydroforming.

Experience has demonstrated the benefit of such an apparatus, which is easily transportable and thus permits the formation in situ of bellows having large diameters without the necessity for a high powered press. It will be noted, however, that such a method loses part of its economic advantage when only a single bellows is to be formed because, not only is it necessary to form a casing, but also to reinforce the latter by means of a cement core.

The improvements which are the object of the present invention aim at remedying the aforesaid disadvantage and enabling an apparatus of the aforesaid type to be provided which can be employed to obtain a single bellows or a very small series thereof.

The invention consists essentially in admitting the fluid under controlled pressure into the annular space between the sheath to be shaped and a deformable sleeve disposed within the sheath, this latter and the sleeve being placed between two plates of which at least one is associated with a device for applying axial thrust.

It will be understood that no supporting concrete core or like means needs to be provided, since reliance is, on the contrary, placed on the localised deformations of the inner sleeve to permit the displacement of the plate subjected to the thrust and the correct corrugation of the sheath to be shaped.

The attached drawing, given by way of example, will permit a better understanding of the invention, its characteristics and the advantages which can be obtained thereby.

Figure 1:
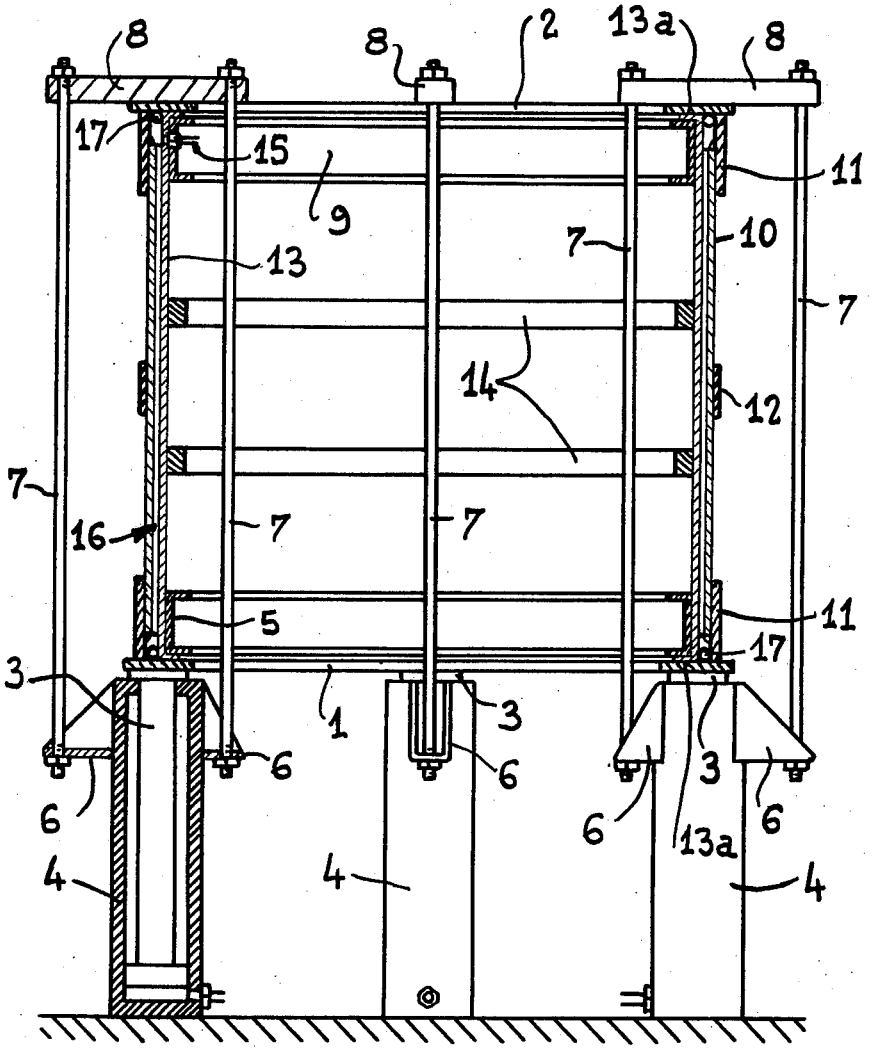

FIG. 1 is a schematic axial cross-section of an apparatus according to the present invention.

Figure 2:
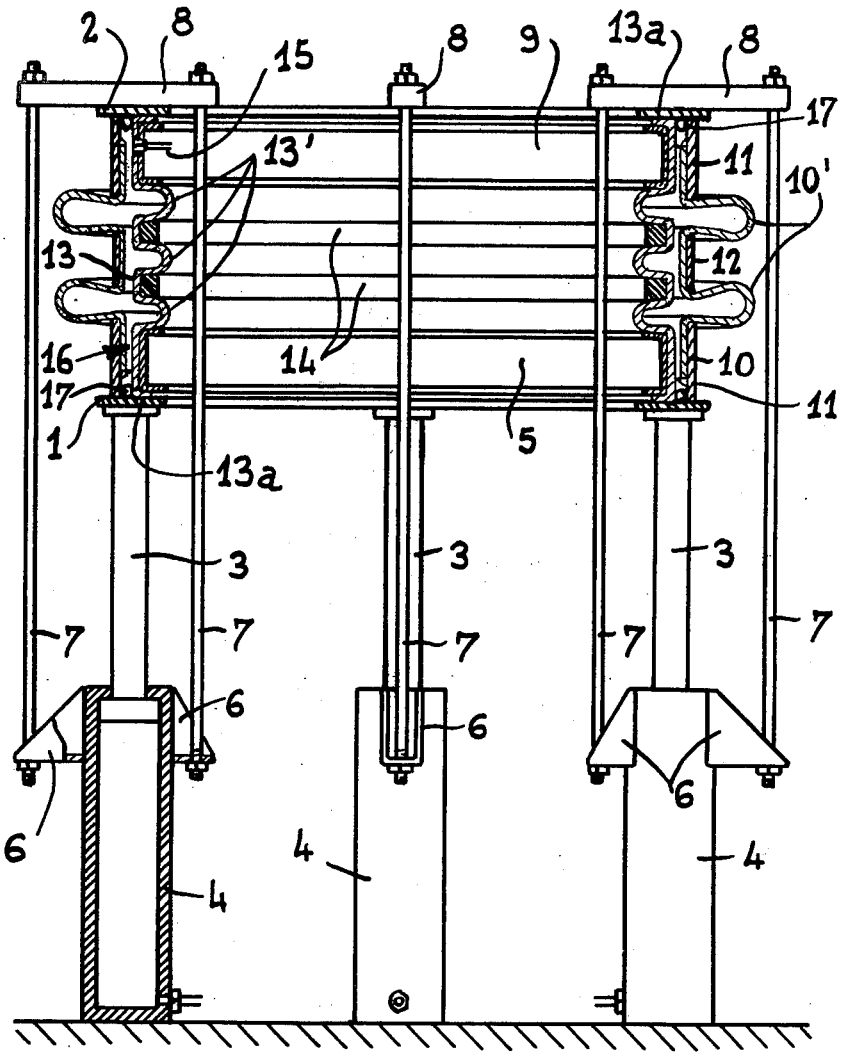

FIG. 2 reproduces FIG. 1 at the end of corrugating the sheath.

Figure 3:
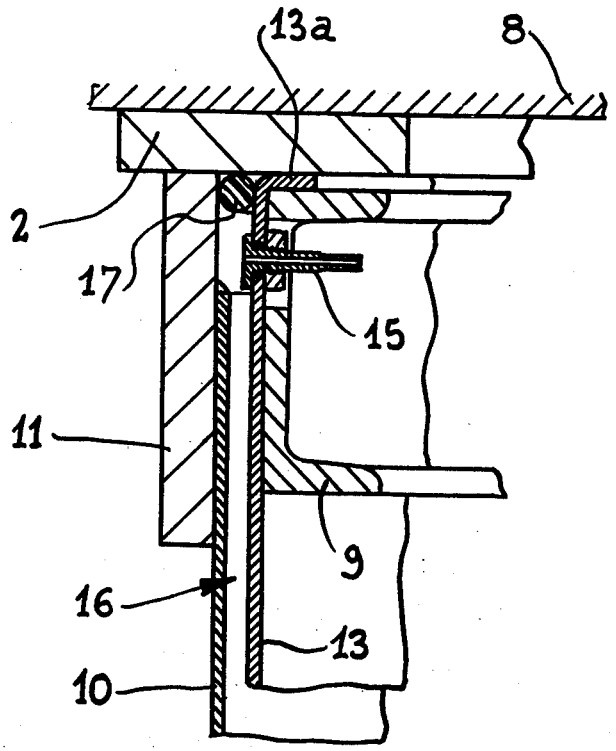

FIG. 3 shows, to a larger scale, a detail of the assembly represented in FIGS. 1 and 2.

The apparatus under consideration comprises a lower movable plate 1 and an upper fixed plate 2, both of annular form. The plate 1 bears against the movable parts 3 of a series of jacks, of which the cylinders 4 rest on the ground, the jacks 3–4 being four in number in the example illustrated; on this plate 1 is disposed on an annular support 5, obtained by assembling together an appropriate number of elements of part-circular shape. Each jack 3–4 is provided with a bracket 6 on which are fixed two tie rods 7 which extend vertically upwardly to support a plate 8, the four plates 8 being associated with an annular support 9 identical with the support 5, as will be understood hereafter.

In order to explain the operation and the manner of use of the apparatus according to the invention, it will be supposed that the bellows to be formed is required to have two deformable corrugations provided between two connecting flanges. For this purpose, there is provided, in a manner which is conventional in the technique of hydroforming, a sheath 10 of appropriate diameter and length, having two flanges 11 and an annular stay 12 held in position by means of removable clamping means (not shown).

There is additionally provided an internal sleeve 13 having a diameter very slightly less than that of the sheath 10 to be shaped; the internal wall of this sleeve 13 carries two annular stays 14 at convenient positions.

With the bars 8 removed, there is first placed in position on the lower plate 1 the lower support 5 and the sleeve 13 which rests on said plate by means of a rim similar to that shown at **13*a* in FIG. 3. There is then engaged around this sleeve 13 the sheath 10 with its flanges 11 and stay 12, this latter being clamped in such a manner as to be situated between the two internal stays 14 of the sleeve. It is then sufficient to introduce the upper support 9 into the open end of the sleeve 13 and to cover over the assembly with the aid of the upper plate 2 which rests on the flange 11 and on the flange of the aforesaid support 9**, this latter being retained in place in any appropriate manner, for example with the aid of a clamping mechanism associated with the aforesaid plate.

Once the plates 8 have been placed in position, the apparatus is ready to operate. As shown in FIG. 3, the sleeve 13 is provided with connections 15 which permit the injection into the annular space between the opposed walls of the sheath 10 and the sleeve 13, of a liquid (water for example) under controlled pressure, in the usual manner for the technique of hydroforming; sealing of the annular space 16 is ensured adjacent to its ends for example by means of seals such as those at 17. At the same time, and advantageously from the same hydraulic installation, the jacks 3–4 are actuated to extend so as to exert an upward thrust on the lower plate 1. The sheath 10 is consequently caused to buckle locally, passing outwardly through the two spaces formed between the flanges 11 and the central stay 12 (FIG. 2), in the same manner as the internal sleeve 13 which deforms inwardly at 13'.

When the corrugations 10' thus obtained on the sheath 10 have attained the desired volume, the operator cuts off the pressure supply to the jacks 3–4 and to the annular space 16 and proceeds with the dismantling of the apparatus with a view to extracting the formed bellows. The sleeve 13 is, of course, thrown away since it cannot be reused, but when only a single bellows is made, the cost of this deformable sleeve is much lower than that of the concrete core necessary for operation according to the earlier patent application referred to at the beginning of this Specification. Moreover, trials have shown that, by judicious manipulation of the pressures of the liquids admitted into the jacks 3–4 and in the annular space 16, the hydroforming process can be controlled in a more precise manner.

The sleeve 13 should, of course, be formed from a deformable metal, but recourse may be had to non-metallic materials, particularly natural or synthetic rubber and plastics materials etc. . . . The assembly of this sleeve between the annular plates 1 and 2 is intended to be carried out in any convenient manner, the example illustrated in FIG. 3 being in no way limitative.

It should, moreover, be understood that the preceding description has been given by way of example only and in no way limits the scope of the invention, which is not exceeded by replacing various details described above by any other equivalents. It is envisaged in particular that the jacks 3–4 can be of any appropriate type (annular hydraulic jack, pneumatic jack, etc.)

I claim:

1. Apparatus for the manufacture, by the technique of hydroforming, of deformable expansion bellows for pipe-work and similar assemblies, comprising means for supporting a deformable sheath from which the bellows is to be formed, means for supporting a sleeve within the sheath to define a generally annular space therebetween, means for introducing into the space a liquid under pressure to deform a portion of the sheath outwardly and to deform a portion of the sleeve inwardly, and means for applying axial thrust to the sheath and sleeve locally during application of pressure to said space by the liquid, the thrust compressing the sheath and sleeve.

2. Apparatus according to claim 1 wherein the means for supporting the sheath and sleeve are annular plates against which the sheath and sleeve bear, one of the plates being acted on by said means for applying axial thrust, the other being axially immobilised and dismountable to permit the extraction of the bellows formed.

3. Apparatus according to claim 1 wherein the supports for the sleeve are formed to the internal diameter of the sleeve and arranged to retain the ends of the sleeve axially.

4. Apparatus according to claim 1 comprising annular stiffening stays arranged to engage the inner wall of the sleeve, the location of the stays determining the inwardly deformed portion of the sleeve.

5. A process using a hydroforming technique for manufacturing a deformable expansion bellow from an axially-extending sheath, the process comprising:

positioning an axially-extending deformable sleeve on a support with the axis of the sleeve being perpendicular to the support;

positioning the sheath on the support coaxial with and surrounding the sleeve, the outer wall of the sleeve cooperating with the inner wall of the sheath to define an annular space; and axially compressing the sleeve and sheath while adding a fluid under pressure to the annular space so that the wall of the sheath is deformed locally outward by the fluid under pressure thereby forming the bellows, and the wall of the sleeve is deformed locally inward.

6. The process according to claim 5, wherein the sleeve and sheath have open ends, the process further comprising:

positioning the open ends of the sleeve and sheath between two axially aligned annular plates, one of the plates being axially immobilized to form the support; and exerting an axial force on the other of the plates thereby axially compressing the sleeve and sheath.

7. The process according to claim 6, wherein the axially immobilized plate is dismountable to allow positioning and removal of the sheath.

8. The process according to claim 6, wherein the open ends of the sleeve are axially retained on the annular plates by means of annular supports disposed inside the said ends.

9. The process according to claim 6, wherein the plates are vertically aligned, and wherein the axial force is exerted by axial thrust means comprising a series of lower jacks supporting the lower annular plate, and vertical tie rods joining fixed parts of said jacks to the upper annular plate.

10. The process according to claim 5, wherein the inner wall of said sleeve is provided with stiffening stays adapted to determine inwardly extending corrugations on said sleeve.

* * * * *